US010066390B2

(12) United States Patent
Pospisil et al.

(10) Patent No.: US 10,066,390 B2
(45) Date of Patent: Sep. 4, 2018

(54) TWO-HOUR FIRE-RATED MODULAR FLOOR/CEILING ASSEMBLY

(71) Applicant: UNITED STATES GYPSUM COMPANY, Chicago, IL (US)

(72) Inventors: Frank Pospisil, Oak Park, IL (US); Gary Miller, Palatine, IL (US); James Ullett, McHenry, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/704,981

(22) Filed: Sep. 14, 2017

(65) Prior Publication Data

US 2018/0119421 A1 May 3, 2018

Related U.S. Application Data

(60) Provisional application No. 62/416,398, filed on Nov. 2, 2016.

(51) Int. Cl.
*E04B 5/10* (2006.01)
*E04B 1/24* (2006.01)
(Continued)

(52) U.S. Cl.
CPC ..... *E04B 5/10* (2013.01); *E04B 1/24* (2013.01); *E04B 1/3483* (2013.01); *E04B 1/40* (2013.01);
(Continued)

(58) Field of Classification Search
CPC ..... E04B 5/10; E04B 9/24; E04B 1/40; E04B 1/3483; E04B 1/7612; E04B 1/94; E04B 1/24; E04B 2103/06; E04B 2001/405
See application file for complete search history.

(56) References Cited

U.S. PATENT DOCUMENTS 1,336,683 A * 4/1920 Davies ..... E04B 1/74 52/347
1,582,172 A * 4/1926 Foster ..... E04B 5/29 52/328
(Continued)

FOREIGN PATENT DOCUMENTS

FR 2580015 A * 10/1986
JP 5010171 B2 1/2007
WO WO-0009827 A1 * 2/2000 ..... E04B 1/3483

OTHER PUBLICATIONS

International Search Report from corresponding International Patent Application No. PCT/US2017/058651, dated Jan. 30, 2018.

*Primary Examiner* — Jeanette E Chapman
(74) *Attorney, Agent, or Firm* — Greer, Burns & Crain, Ltd.; Pradip K. Sahu; Philip T. Petti

(57) ABSTRACT

A floor-ceiling assembly is provided for joined upper and lower modular construction units, including a floor surface of the upper unit using structural cement panels; a floor grid including at least one floor joist and at least one beam each having an upper surface receiving said structural cement panels, a web and a lower surface. At least one connector plate is secured to the lower surface. A ceiling framework of the lower unit has at least one ceiling beam and at least one ceiling joist secured to each other, at least one of the beams is secured to the at least one connector plate. A resilient channel is secured to an underside of the ceiling framework, and a ceiling panel is secured to the resilient channel.

11 Claims, 4 Drawing Sheets

(51) Int. Cl.

| | |
|---|---|
| ***E04B 1/34*** | (2006.01) |
| ***E04B 1/76*** | (2006.01) |
| ***E04B 1/94*** | (2006.01) |
| ***E04B 9/24*** | (2006.01) |
| ***E04B 1/348*** | (2006.01) |
| ***E04B 1/41*** | (2006.01) |
| *E04B 1/38* | (2006.01) |

(52) U.S. Cl.
CPC ..... *E04B 1/7612* (2013.01); *E04B 1/94* (2013.01); *E04B 9/24* (2013.01); *E04B 2001/405* (2013.01); *E04B 2103/06* (2013.01)

(56) References Cited

U.S. PATENT DOCUMENTS 2,104,873 A * 1/1938 Levy ..... E04B 2/62 52/236.3
2,143,887 A * 1/1939 Kotrbaty ..... E04B 5/29 52/262
2,148,496 A * 2/1939 Park ..... E04B 9/001 181/290
2,268,311 A * 12/1941 Sheehan ..... E04B 5/29 52/328
2,358,147 A * 9/1944 Colburn ..... E04B 2/84 425/DIG. 121
2,592,634 A * 4/1952 Wilson ..... E04B 1/04 52/125.5
3,678,638 A * 7/1972 Mougin ..... E04B 1/34807 52/208
3,750,366 A * 8/1973 Rich, Jr. ..... E04B 1/34807 52/79.11
3,793,793 A * 2/1974 Dobbins ..... E04B 5/48 138/117
3,990,193 A 11/1976 Ray et al.
4,045,937 A 9/1977 Stucky
4,525,975 A 7/1985 McWethy
4,885,884 A * 12/1989 Schilger ..... E04B 5/04 52/354
5,737,895 A * 4/1998 Perrin ..... E04B 1/165 52/236.8
5,782,047 A 7/1998 De Quesada
5,867,964 A * 2/1999 Perrin ..... E04B 1/165 52/236.8
5,881,516 A 3/1999 Luedtke
6,298,617 B1 10/2001 De Quesada
7,941,975 B2 * 5/2011 Ingjaldsdottir ..... E04B 1/3483 52/235
7,975,446 B2 * 7/2011 Hall ..... E04B 5/10 52/236.7
9,121,168 B2 * 9/2015 Levy ..... E04B 1/3483
2004/0250482 A1 12/2004 Jacobson et al.
2006/0191232 A1 * 8/2006 Salazar ..... E04B 5/043 52/606
2007/0271857 A1 * 11/2007 Heather ..... B65D 88/005 52/79.9
2011/0047889 A1 3/2011 Gad et al.
2014/0260031 A1 * 9/2014 Salazar ..... E04C 2/22 52/309.16
2016/0083961 A1 * 3/2016 Cornia ..... E04H 7/04 52/210

* cited by examiner

TWO-HOUR FIRE-RATED MODULAR FLOOR/CEILING ASSEMBLY

RELATED APPLICATION

This application is a Non-Provisional of, and claims 35 USC 119 priority from, U.S. Patent Application Ser. No. 62/416,398, filed Nov. 2, 2016, which is incorporated by reference.

BACKGROUND

The present invention relates generally to modular construction techniques for erecting multi-story residences, and more specifically to an improved floor/ceiling construction for such modules having an enhanced fire rating.

It is a growing trend to construct multi-story residential buildings, including hotels, apartments, dormitories, classrooms, restaurants and the like using modular units, especially in crowded urban areas where heavy construction equipment has difficulty maneuvering. Modular construction reduces material waste, and since the units are assembled indoors at remote locations, labor costs and working conditions are more closely controlled. Such modules are remotely constructed and assembled, trucked to the building site, then placed in position using a crane. Many modules are as long as 75 feet and are assembled by stacking vertically, side-by-side, end-to-end, thus providing a variety of configurations of the final building design.

Each module has a steel frame including beams and joists, and depending on the application represents one or two apartment units. Walls are conventionally assembled with studs and panels, and windows are installed in the stud frames in a conventional manner. Designers of such modules need to take into account that the ceiling of a lower module becomes part of the floor/ceiling assembly when combined with the floor of the next higher module. In many cases, the floors of the modules are poured concrete having a weight as much as 40 pounds per square foot (psf) and a 3-inch thick layer. One drawback of conventional modules is the weight, of which the poured concrete floor is a significant contributor. Heavier modules are more expensive to ship by truck to the site, and are more difficult to raise into position. Also, the design of conventional modules is constrained due to a significant amount of module height being allotted to the junction of two adjacent vertically stacked units.

Thus, there is a need for an improved modular building unit which addresses the drawbacks listed above.

SUMMARY

The above-listed needs are met or exceeded by the present two-hour fire-rated modular floor/ceiling assembly, which features the use of structural cement panels forming the floor surface. These panels have been found to be significantly lighter than conventional concrete floors, but with sufficient strength for the application. Further, the use of structural cement panels in the floor surface, along with the steel frame, has been found to pass an industry accepted two-hour fire rating. (UL 263, and ASTM E119). The present modular assembly also is vertically thinner compared to conventional modules constructed according to UL G588 or similar, allowing for taller ceilings in the module, or providing for more vertical floors within a given total building height.

Using the structural cement panels for the floor surface, the weight of the present module is significantly reduced, since the present panels have a weight of 5 psf as compared to 40 psf of poured concrete floors. The floor surface has a height of a minimum of ¾ inch, as compared to a 3-inch height/thickness of poured concrete floors. Heights of the present floor/ceiling assembly range from a minimum of 12⅝ inches to 16 inches. The present floor/ceiling assembly is achieved by using the ¾-inch thick structural cement floor panel, which is secured to an upper flange of a steel support, preferably a joist or beam having a 6-inch height. Connections between vertically adjacent units are achieved with a steel plate that is a minimum ¾-inch thick. Insulation, such as bats of fiberglass are placed in a space defined between the joists of the floor grid, below the floor panel.

In the ceiling of the lower unit, the steel frame forms a ceiling framework including preferably 4-inch tall beams and joists which is in registry with the floor grid of the upper unit. The ceiling framework of 4-inch beams and joists is provided, extending linearly and transversely relative to the unit. Junctions between beams and joists forming the ceiling support are formed by conventional 4-inch clip angles, also referred to as angle brackets. Resilient channels are secured to undersides of the ceiling joists, and conventional ⅝-inch gypsum wallboard panels are secured to the resilient channels as is known in the art. The panels form the ceiling of the lower modular unit.

More specifically, the present invention provides a floor-ceiling assembly for joined upper and lower modular construction units, including a floor surface of the upper unit using structural cement panels; a floor grid including at least one floor joist and at least one beam each having an upper surface receiving said structural cement panels, a web and a lower surface. At least one connector plate is secured to the lower surface. A ceiling framework of the lower unit has at least one ceiling beam and at least one ceiling joist secured to each other, at least one of the beams is secured to the at least one connector plate. A resilient channel is secured to an underside of the ceiling framework, and a ceiling panel is secured to the resilient channel.

DETAILED DESCRIPTION

Figure 1:
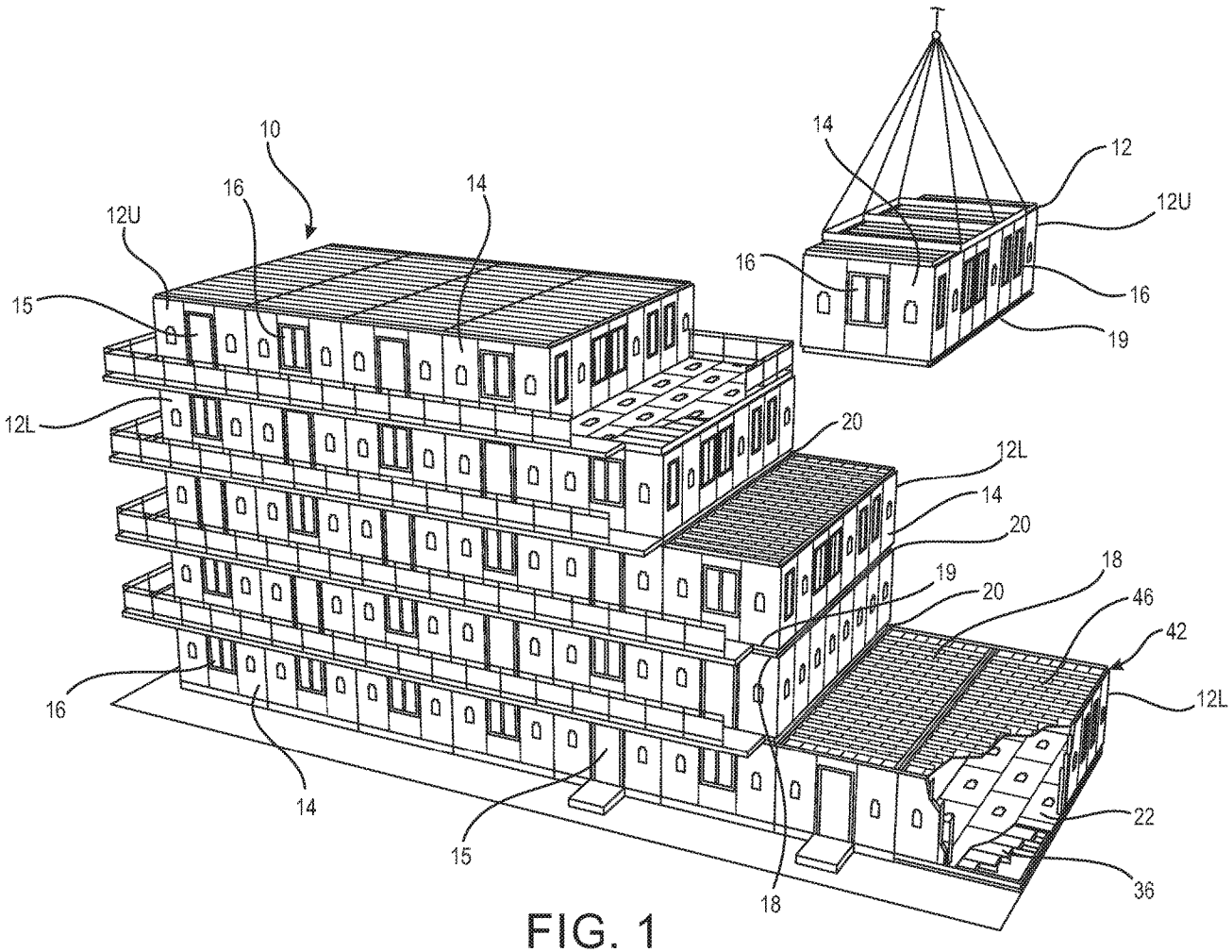
FIG. 1 is a perspective view of a building being made of the present modular assemblies.
Figure 2:
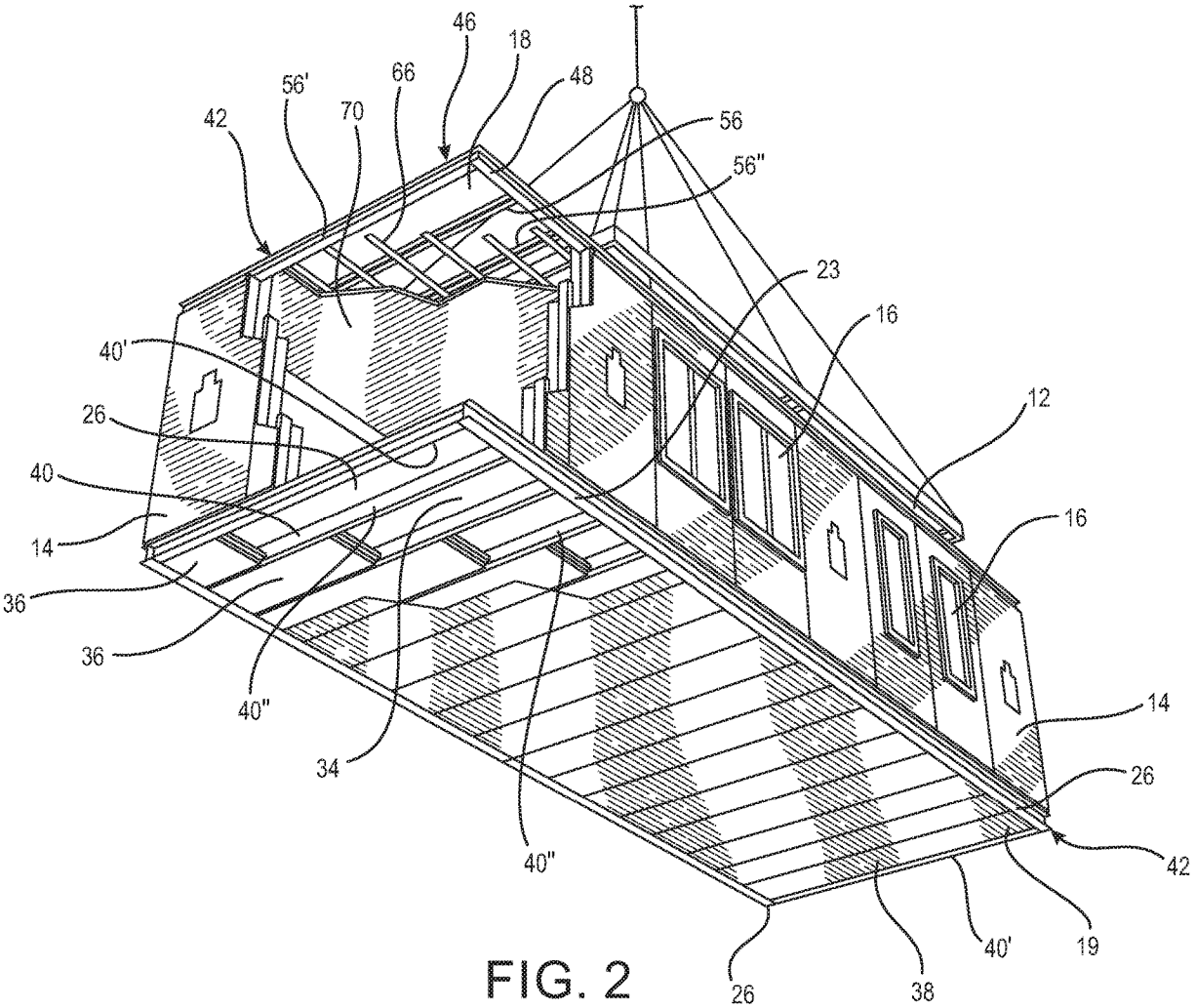
FIG. 2 is a bottom perspective view of the present module.

Referring now to FIGS. 1 and 2, a multi-story building incorporating the present modules is generally designated 10, and includes a plurality of joined module units 12. Each module unit 12 includes a plurality of exterior wall panels 14, doors 15 and windows 16. The wall panels 14 are preferably made of structural cement, according to U.S. Pat. Nos. 7,445,738 and 7,670,520 which are incorporated by reference, however other exterior construction panels are contemplated. A ceiling 18 of a lower unit 12L becomes part of a floor 19 of an upper unit 12U. For the purposes of the present application, the joined floor/ceiling assembly represented by vertically joined units 12U and 12L is generally designated 20. Naturally, as the building 10 is provided with multiple stories, an upper module 12U of one floor/ceiling assembly will serve as the lower module 12L of the next higher story.

Figure 3:
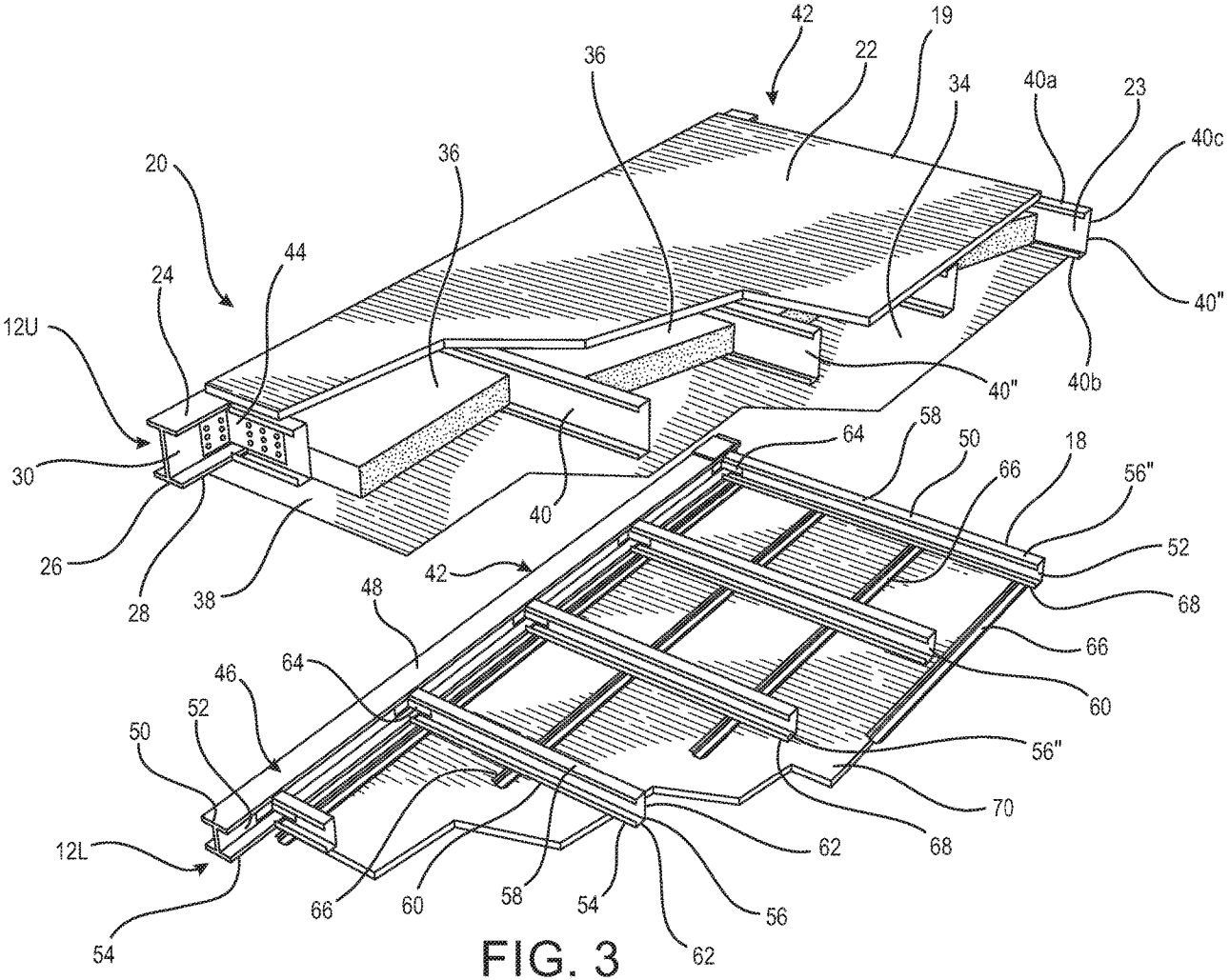
FIG. 3 is a fragmentary perspective view of the present floor/ceiling assembly.
Figure 4:
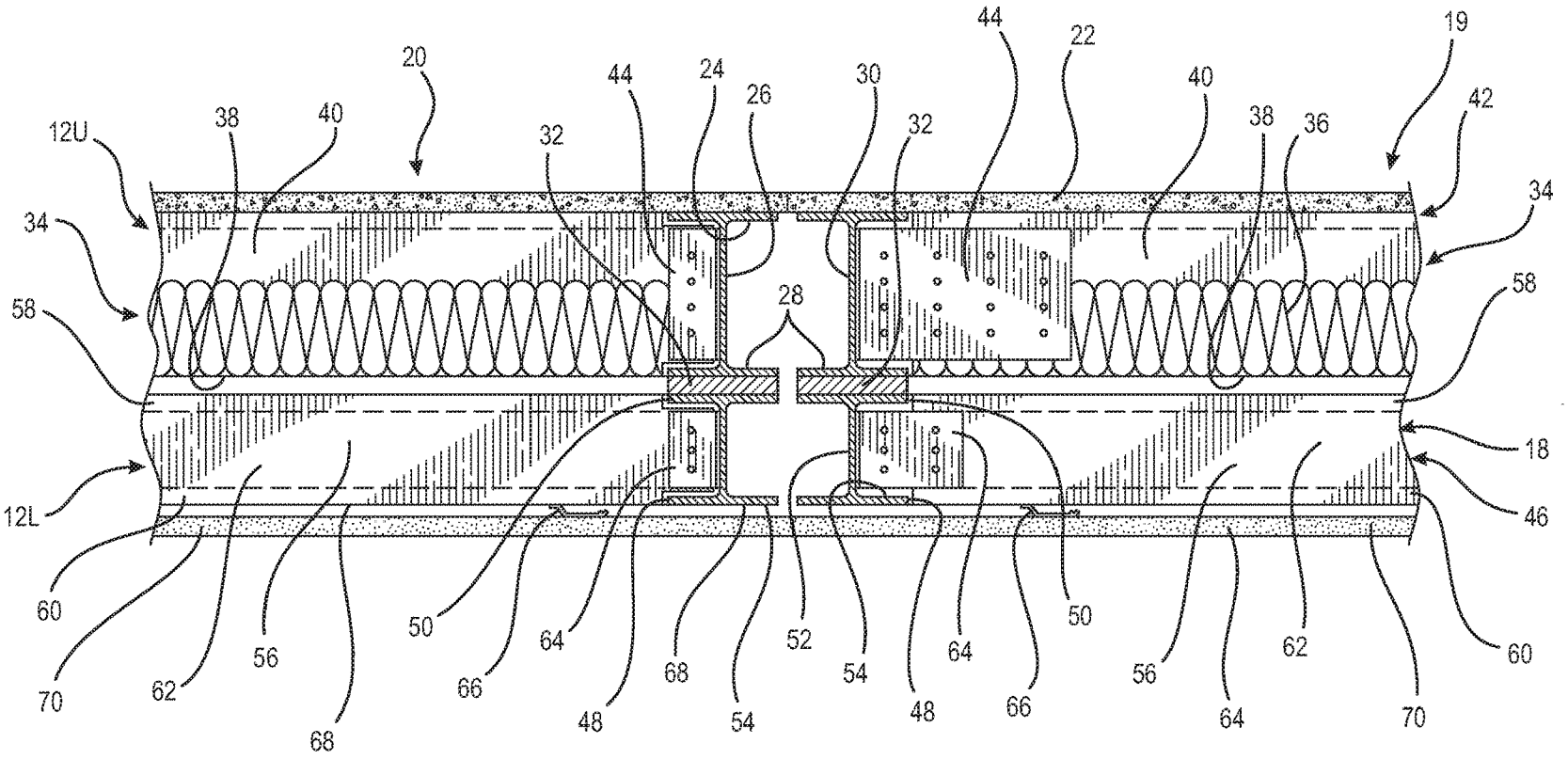
FIG. 4 is a vertical cross-section of the present modular assembly.

Referring now to FIGS. 3 and 4, the floor/ceiling assembly 20 is described in greater detail. A feature of the present assembly 20 is that the floor 19 has a floor surface made of panels 22 of structural cement, sold by United States Gypsum Co. as Structural Panel Concrete Subfloor, also sold under the trademark STRUCTO-CRETE® panels, and is preferably made according to at least one of the above-listed US Patents. In the preferred embodiment, the panels 22 are a minimum ¾-inch thick or tall, with tongue and groove formations on the long edges. A thickness of ¾ inch to 1-inch is preferably contemplated. In the assembly 20, the panels 22 are secured to an upper flange 24 or upper beam surface of at least one and preferably a plurality of floor beams 26, which are conventional "I"-beams including a lower flange 28 or lower beam surface, the flanges separated by a web 30 as is well known in the art, with other shapes contemplated including tubes. In the preferred embodiment, the beam 26 has a minimum height of 6 inches, and is preferably 50 Ksi grade steel, however other sizes are contemplated depending on the application. A long edge of the panels 22 is preferably perpendicular to the beams 26, and the panels are secured to the beam using threaded fasteners (not shown) as are well known in the art.

At least one connector plate 32 is secured to the lower beam surface 28, preferably by welding. In the preferred embodiment, while other sizes are contemplated depending on the application, the connector plate 32 is preferably a minimum ¾-inch thick or having that size height, and is provided in a polygonal shape dimensioned a minimum 4 inches by a minimum 4 inches. Also, the connector plate 32 is used to join the upper unit 12U to the lower unit 12L, again preferably by welding or similar permanent attachment.

A space or cavity 34 between the panel 22 and the lower beam flange 28 is preferably filled with at least one panel or bat of insulation 36, which may be foam, fiberglass or the like, well known in the art. To retain the insulation 36 in place, a layer of netting 38, such as wire or plastic mesh, screen or the like is secured to the floor grid 23, including the beams 26 and the transverse joists 40. The netting 38 is held to the floor grid 23 by wire wrapped around the beams 26 and the joists 40. It is also contemplated that, as a further alternative the wire mesh 38 is bent and wrapped around edges of the beams 26 and the joists 40, then secured with fasteners. In some cases, the wire mesh 38 is bent around and attached to the beams 26 and the joists 40 to form a basket-shape into which the insulation 36 is placed. Then, once the panel 22 is installed upon the beams 26 and the joists 40, the insulation 36 is trapped in place. It is also contemplated that the beams 26 are connected to the transverse joists 40, either "I"-shaped (40') located at ends of the module 12, or "C"-shaped 40" with upper and lower flanges 40*a*, 40*b* and webs 40*c* (with other shapes contemplated, including tubes), secured together to form a frame 42 of the module 12, and are secured to each other using joist clip angles or blocks 44. As is known in the art, the beams 26 and the transverse joists 40 are preferably secured to the joist clip angles 44 by threaded fasteners or welding, as is known in the art.

Referring now to the lower unit 12U of the assembly 20, a ceiling framework 46 includes a plurality of beams 48, and at least one of the beams is secured to the connector plate 32, as by welding or the like to join the units 12U and 12L. In the preferred embodiment, while other sizes are contemplated, the beams 48 are "I"-beams, preferably made of 50 Ksi steel and having a minimum height of 4 inches, including a beam upper flange 50, a beam web 52 and a beam lower flange 54. The beams 48 are preferably in registry with the beams 26 upon connection of the assembly 20, and the framework 46 includes transverse joists 56, which are preferably "I"-shaped 56' at the ends of the module 12 or "C"-shaped 56" (with other shapes contemplated, including tubes). The joists 56 have an upper flange 58, a lower flange 60 and a web 62 secured to the beams 48 at respective ends by clip angle brackets or blocks 64. As is known in the art, the beams 48 and the joists 56 are secured together to form the ceiling framework 46 using the clip angle brackets 64 and threaded fasteners or welding as is known in the art.

Referring now to FIG. 4, at least one resilient channel 66 is secured to an underside 68 of the lower flanges 60 of the joists 56. As is known in the art, the resilient channel 66 is made of steel and is placed perpendicular to the respective joists 56 and secured thereto using threaded fasteners as is known in the art. Multiple channels 66 are positioned across the ceiling framework 46 to support the ceiling 18.

In the preferred embodiment, at least one ceiling panel 70 is secured to the resilient channel 66 using fasteners as is known in the art. It is preferred that the panels 70 are conventional gypsum wallboard, and having a thickness of ⅝-inch.

Fire tests were performed on the assembly 20 under at least one of ASTM E119 and UL 263. Results showed that the assembly 20 met a 2-hour fire rating. In other words, the assembly 20 remained intact when exposed to fire for a 2-hour period.

While a particular embodiment of the present two-hour fire-rated modular floor/ceiling assembly has been described herein, it will be appreciated by those skilled in the art that changes and modifications may be made thereto without departing from the invention in its broader aspects and as set forth in the following claims.

The invention claimed is:

1. A floor-ceiling assembly for joined upper and lower modular construction units, comprising:

a floor surface of the upper unit using premade structural cement panels, each said structural panel has a ¾-1-inch thickness;

a floor grid including at least one floor joist and at least one beam each having an upper surface receiving said structural cement panels, a web and a lower surface, said panels being secured to said grid using fasteners;

at least one connector plate secured to said lower surface;

a ceiling framework of the lower unit having at least one ceiling beam and at least one ceiling joist secured to each other, at least one of said beams secured to said at least one connector plate;

a resilient channel secured to an underside of said ceiling framework; and a ceiling panel secured to said resilient channel.

2. The assembly of claim 1, wherein said floor grid has a minimum height of 6 inches.

3. The assembly of claim 1, wherein said connector plate has a minimum height of ¾ inch.

4. The assembly of claim 1, wherein said ceiling framework has a minimum 4-inch height.

5. The assembly of claim 1, wherein said ceiling panel is gypsum wallboard with a ⅝-inch thickness.

6. The assembly of claim 1, further including at least one layer of insulation between the floor panel and said lower joist surface.

7. The assembly of claim 6, further including a layer of netting for securing said at least one layer of insulation to said joist.

8. The assembly of claim 1, wherein at least one of said floor grid and said ceiling framework includes clip angle brackets for attaching intersecting joist and beams.

9. The assembly of claim 1, achieving a two-hour fire rating pursuant to at least one of ASTM E119 and UL 263.

10. The assembly of claim 1, wherein each said structural panel has a weight of approximately 5 pounds per square foot.

11. A floor-ceiling assembly for joined upper and lower modular construction units, comprising:

a floor surface of the upper unit using premade structural cement panels, each said panel has a weight of approximately 5 pounds per square foot;

a floor grid including at least one floor joist and at least one beam each having an upper surface receiving said structural cement panels, a web and a lower surface, said panels being secured to said grid using fasteners;

at least one connector plate secured to said lower surface;

a ceiling framework of the lower unit having at least one ceiling beam and at least one ceiling joist secured to each other, at least one of said beams secured to said at least one connector plate;

a resilient channel secured to an underside of said ceiling framework; and a ceiling panel secured to said resilient channel, said assembly achieving a two-hour fire rating pursuant to at least one of ASTM E119 and UL 263.

* * * * *